United States Patent [19]

St. Denis

[11] Patent Number: 4,852,447

[45] Date of Patent: Aug. 1, 1989

[54] STRING ARRANGEMENT FOR A MUSICAL INSTRUMENT

[76] Inventor: Carroll R. St. Denis, 146 Dowling Avenue, Winnipeg, Manitoba, Canada, R2C 0Z8

[21] Appl. No.: 194,140

[22] Filed: May 16, 1988

[51] Int. Cl.[4] ..... G10D 3/00

[52] U.S. Cl. ..... 84/297 R; 84/303

[58] Field of Search ..... 84/297 R, 297 S, 303

[56] References Cited

U.S. PATENT DOCUMENTS 4,377,963 3/1983 Siminoff ..... 84/297 R

*Primary Examiner*—L. T. Hix
*Assistant Examiner*—Brian W. Brown
*Attorney, Agent, or Firm*—Adrian D. Battison; Stanley G. Ade; Murray E. Thrift

[57] ABSTRACT

A string arrangement for attachment to a conventional stringed instrument comprises a substantially conventional string which is carried upon a reel member surrounded by a cover member with the string passing through an opening in the cover member. The reel member carries a sleeve portion which can be pressed over the conventional peg of a guitar or other instrument and can be attached thereto for rotation by a pin passing through the transverse conventional hole of the peg. In this way the string can be readily applied by attaching the free end to the base of the guitar in conventional manner and unreeling the string to a position where the reel member attaches to the conventional peg with little slack in the string. Rotation of the conventional string tensioning key then operates directly upon the reel member to wind in the string onto the reel member and to provide the necessary tensioning of the string.

2 Claims, 1 Drawing Sheet

STRING ARRANGEMENT FOR A MUSICAL INSTRUMENT

BACKGROUND OF THE INVENTION

This invention relates to a string arrangement for attachment to a musical instrument of the type in which the string can be attached at first and second spaced positions on the instrument, can be tensioned by adjustment of one of the positions for example by rotation of a post to which the string is attached and can be vibrated when so tensioned to produce a musical note.

Such instruments are of various different types including guitars, banjos and the present invention is particularly designed but not exclusively designed for use with a guitar.

The strings of a guitar are generally attached between a suitable connector member at the base of the guitar, over the bridge to a tensioning device at the neck of the guitar. Generally the tensioning device comprises a post which stands upwardly from the fret board of the guitar and can be rotated by a key which communicates with the post through a suitable gearing arrangement so that the key can be manually driven to rotate the post to tension the string but the gearing arrangement prevents the post from slipping after the desired tension is achieved.

Replacement strings for the guitar are generally supplied in a package in which the string is loosely contained or wrapped around a suitable former. The string generally has on a first end a suitable attachment mechanism for attachment of the first end to the base of the guitar. In some cases the attachment mechanism comprises a stud which is held onto the string by a loop in the string so the stud can be inserted into the conventionally provided opening at the base of the guitar. In other cases the string is merely looped at the first end so that it can be wrapped around a bar at the base of the guitar with the bar holding all of the looped strings. At the other end, the string is attached to the post member by simply passing a free end of the string through a hole transverse to the post member so that it is latched by the hole and is wrapped around the post by rotating the post by the manual key.

Such strings are inconvenient to apply and are unattractive in their supplied appearance. In many cases the user is not willing to crank the manual key a sufficient number of times to wind up all of the loose end of the string onto the post and accordingly the loose end is left hanging leaving an inconvenient and unattractive appearance.

It is one object of the present invention, therefore, to provide an improved string arrangement which enables the string to be supplied and attached in a simpler manner which is more convenient for the user and provides an attractive appearance when completed. In addition the string arrangement is attractive in its supplied appearance and provides itself areas for suitable advertising materials and information.

According to the first aspect of the invention, therefore, there is provided a string arrangement for attachment to a musical instrument of the type in which the string, when attached at spaced first and second positions on the instrument and tensioned by adjustment of one of said positions, is vibrated to produce a musical note, the string arrangement comprising an elongate string, a reel member, one end of the string being attached to the reel member with the string wrapped around the reel member leaving a free end of the string, cover means at least partially surrounding the reel member and defining an opening through which the free end projects, said opening confining the string for removal from the reel member solely by longitudinal movement of the string caused by pulling of the free end, means on the reel member for attachment of the reel member to said first position on said instrument and means on the free end of the string for attachment of the free end to said second position on the instrument.

According to the second aspect of the invention there is provided a string arrangement for attachment to a musical instrument of the type in which the string, when attached at spaced first and second positions on the instrument and tensioned by adjustment of one of said positions, is vibrated to produce a musical note, the string arrangement comprising an elongate string, a reel member, defining a cylindrical surface around an axis of the reel member, one end of the string being attached to the reel member with the string wrapped around the reel member leaving a free end of the string, a sleeve member coaxial with said reel member axis and co-rotatably connected to said reel member and arranged with a coaxial base therein for placement over a post at said first position on said instrument, said sleeve member including a transverse hole, a pin member which can be pressed through said hole and through a cooperating hole in said post cover means at least partially surrounding the reel member and defining an opening through which the free end projects, said opening confining the string for removal from the reel member solely by longitudinal movement of the string caused by pulling of the free end, and means on the free end of the string for attachment of the free end to said second position on the instrument.

According to a third aspect of the invention there is provided a string musical instrument comprising an instrument body, a string arrangement including an elongate string, means for attachment of one end of one string to the body at a first position thereon and means for attachment of an opposed end of the string to the body at a second position thereon, said attachment means at one of said positions being adjustable to adjust tension in the string such that when the string is vibrated it produces a musical note, said string arrangement comprising a reel member, said one end of the string being attached to the reel member with the string wrapped around the reel member leaving said opposed end of the string free, cover means at least partially surrounding the reel member and defining an opening through which the free end projects, said opening confining the string for removal from the reel member solely by longitudinal movement of the string caused by pulling of the free end, reel attachment means on the reel member attaching the reel member to said first position on said instrument and means on said opposed free end of the string attaching said free end to said second position on the instrument.

The reeled string can therefore be attached to the guitar very simply by attaching the free end of the string to the conventional attachment at the base of the guitar. The string is then pulled out from the reel member to a length just sufficient to extend between the post or other attachment at the neck end and the attached free end so that the reel member can be attached on to the post and latched against free rotation relative to, the post. Only a very short turning movement of the post is then necessary to rewind any excess string pulled out from the reel member and to provide the tensioning of the string which is necessary for the required note. The replacement of a full set of strings is therefore very simple and quick and is provided by the simple addition of very inexpensive plastics parts defining the cover means, reel member and latching means.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
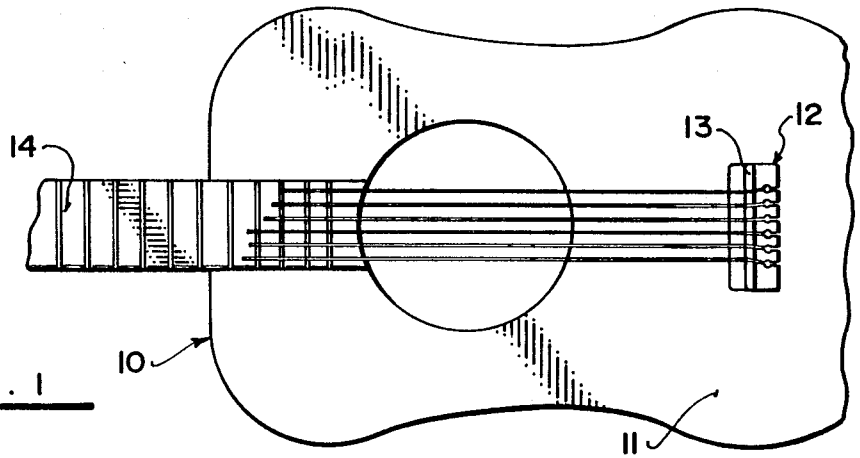
FIG. 1 is a top plan view of a guitar including a string arrangement according to the present invention.

A conventional guitar is illustrated in FIG. 1 and comprises a guitar body 10 having a base 11 on which is attached the string board 12 to which the free end of the strings is attached. The string board carries a bridge 13 which lifts the string away from the guitar body so that the strings when tensioned are carried at a position slightly above a fret board indicated at 14 on the neck 15 of the guitar. The upper end of each of the strings is conventionally attached to one of six pegs 16 each of which can be rotated by a manually graspable key 17 through conventional gearing (not shown) which causes the peg to tighten the string to hold it at the required tension across the fret board.

As previously described in a conventional attachment the peg comprises a simple vertical peg with a transverse hole so that the string has an open end which passes through the hole so that the string can be wound up onto the peg by rotation of the peg until all slack is removed and then the necessary tension applied.

Figure 3:
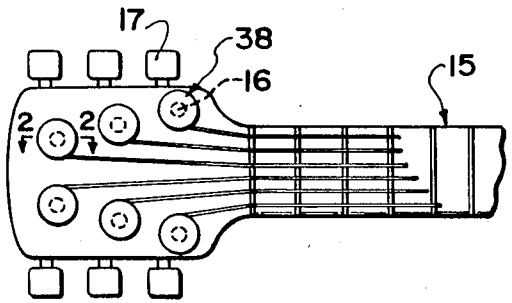
FIG. 3 is a cross sectional view similar to that of FIG. 2 showing the device before attachment to the guitar.
Figure 3:
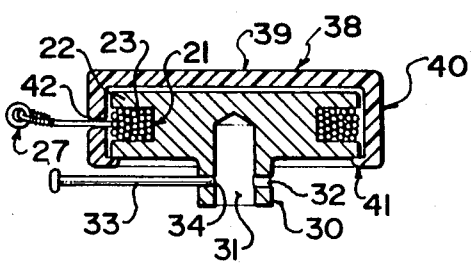
Figure 2:
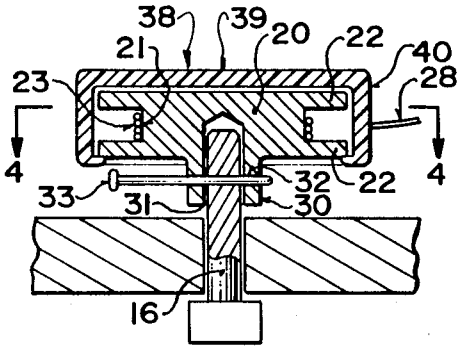
FIG. 2 is a cross sectional view on a much enlarged scale along the lines 2—2 of FIG. 1.
Figure 4:
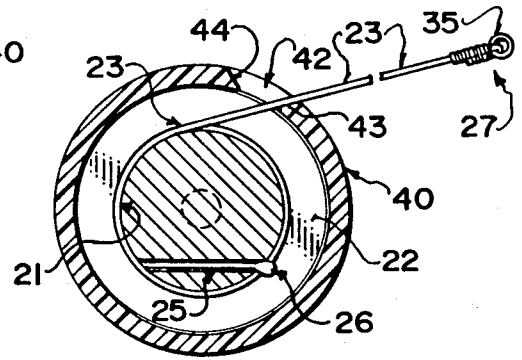
FIG. 4 is a cross sectional view along the lines 4—4 of FIG. 2.

Turning now to FIGS. 2, 3, and 4 there is shown a string arrangement which replaces the conventional string and allows the string to be attached and tensioned more readily and with a simple attractive casing arrangement.

Thus the device comprises a reel member 20 which defines a cylindrical surface 21 and a pair of flanges 22 extending radially outwardly on either side of the cylindrical surface so as to define a receiving area for the string 23 wrapped thereupon. The size of the receiving area is arranged so as to receive sufficient turns of the string to accept a long enough string to accommodate the length of the guitar or other instrument on which it is to be attached. The size of the receiving area must also of course depend upon the diameter of the string which of course varies in dependance upon the instrument concerned and the note of that instrument.

One end of the string is attached to the central boss of the reel member by passing through an opening 25 formed as a cord through the cylindrical surface 21 with a suitable knot or other attachment mechanism 26 on the open end of the string so that it cannot move relative to the cylindrical surface. In FIG. 3 a large number of turns is wrapped around the reel member since the device is in the condition prior to attachment to the guitar when the string is wrapped fully around the reel member and is substantially hidden with merely a free end indicated at 27 extending outwardly from the reel member. In FIG. 2 only a small number of turns remains on the reel member since the remainder of the string indicated at 28 has been withdrawn and the free end attached to the string board 12.

Attached to the reel member and integrally formed therewith is a sleeve member 30 which is coaxial with the cylindrical surface 21 and extends outwardly from one end of the reel member. Inside the sleeve member and extending into the body of the reel member is a bore 31 which again is coaxial with the cylindrical surface 21 and extends from an outer end of the sleeve member 30. As shown in FIG. 2, the bore 31 is defined to receive the peg or post 16 of the conventional guitar so that the reel member as a whole is a press fit onto the post 16 and when attached thereto it stands upwardly therefrom and is arranged coaxially relative thereto.

The sleeve member 30 has a transverse bore 32 within which is mounted a separate pin 33. In the position shown in FIG. 3 prior to attachment of the device to the peg 16, the pin has an inner end 34 which terminates just at the edge of the bore 31 so that the sleeve member can be slipped over the peg 16 without interfering the pin 33. The pin 33 at its other end projects outwardly beyond the radial extent of the reel member so that it can be engaged by the finger of the user and pressed against the surface of the peg 16 until the transverse opening of conventional type in the peg 16 is located and the pin passes through to hold the sleeve member fixed in place on the peg 16. This position is shown in FIG. 2.

In an alternative arrangement (not shown) the pin 33 can be replaced by a spring mounted latch member which automatically engages the transverse bore in the peg 16 after slight manual adjustment of the reel member so that it locates the transverse bore in the peg 16.

The free end of the string indicated at 27 is arranged to be of a conventional type for attachment to the string board 12 of the guitar. In the example shown at the free end there is provided a stud member 35 which is in the form of a ring so that the string can pass through a central opening in the ring and can then be looped back and attached in place by a wrapping 36 of the string or of an outer wrapping of the string depending upon the type of string used. This attachment device is of a conventional type and is used in the type of guitar where plugs are provided in the string board which can be removed and the member 35 inserted and the plug replaced to hold the member 35 in place attached to the string board.

In other cases (not shown) the end of the string can be constituted by a simple loop in the string which is then looped around a string bar again of conventional type.

An outer cover member for the reel member is indicated at 38 and comprises an end face 39 and a cylindrical surface portion 40 surrounding the outer extremities of the reel member. The cover member is arranged to be a press fit onto the outer surface of the reel member so that the reel member can rotate within the cover member but is inhibited or prevented against movement out of the cover member by its engagement therewith. In one example a small rib 41 can be formed around the inner edge of the cylindrical surface 41 so as to hold the reel member against axial movement away from the cover member.

A hole 42 is provided in the cover member through which the string extends from the reel member. In the example shown the hole 42 is cut such that defines a tangential surface 43 and a second tangential surface 44 which are arranged at left and right hand directions to accommodate the left hand right hand directions of escape of the string from the cover member as indicated in FIG. 1. The cover member is free to rotate on the reel member so that in use the free end of the string can be attached to the string board following which the cover member is grasped manually and pulled toward the upper end of the guitar. As the string is pulled, the reel member rotates to release the length of string until the reel member reaches the peg 16 with which it is associated. The reel member is then pressed over the peg as previously described and the pin 33 pressed into place. This can be done without significant release of excess string so that the excess can be drawn up very quickly into the reel member by rotation of the key 17. This can often be done within less than 180° of rotation of the peg 16 following which all further rotation provides the necessary tensioning of the string.

In an alternative arrangement (not shown) the guitar can be modified so that the strings are attached simply at the upper end and the reel member is mounted on the string board on suitable pegs. The device operates in the same manner except that tensioning of the string takes place from the free end rather than the reel end.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A string arrangement for attachment to a musical instrument of the type in which the string, when attached at spaced first and second positions on the instrument and tensioned by adjustment of one of said positions, is vibrated to produce a musical note, said first position on the instrument including a circular cylindrical post having a transverse hole therethrough for receiving a string, the string arrangement comprising an elongate string; and integrally molded, unitary reel member, defining a cylindrical surface around an axis of the reel member and a pair of flanges circumferentially surrounding the cylindrical surface and extending radially therefrom at respective ends thereof, one end of the string being attached to the reel member with the string wrapped around the reel member on the cylindrical surface and between the flanges leaving a free end of the string, said reel member further defining a sleeve member coaxial with said reel member axis and extending axially beyond one flange, said sleeve member having an outer peripheral surface of a diameter less than that of the flanges and an inner recess of a circular cylindrical shape extending axially therealong from an opening on a base surface of the sleeve member lying in a radial plane and remote from said one flange, said recess being shaped to pass over said post at said first position on said instrument, said sleeve member including a transverse hole extending from the outer peripheral surface into said inner recess; a pin member mounted in the hole and having a length such that it extends from the recess to a radial position beyond the diameter of the flanges and a diameter such that it can be pressed in a radial direction through said hole and through said transverse hole in said post; a cover member comprising an integrally molded unitary body having a circular end wall and a cylindrical flange extending axially from the periphery of the end wall, the cylindrical flange fully surrounding the cylindrical surface and extending from the end wall which lies closely adjacent an end face of the other of the flanges to an outermost edge of the cylindrical flange which extends just beyond said one of the flanges, said cylindrical flange and said one flange cooperating to locate said cover member against axial movement away from said reel member, the cylindrical flange including an opening therein through which the free end projects, said opening confining the string for removal from the reel member solely by longitudinal movement of the string caused by pulling of the free end, and means on the free end of the string for attachment of the free end to said second position on the instrument.

2. A musical instrument comprising a body, a string attached at spaced first and second positions on the instrument body and means for adjusting the tension in the string at a first one of said positions, said first position on the instrument including a circular cylindrical post having a transverse hole therethrough for receiving a string, and a string attachment arrangement comprising an integrally molded, unitary reel member, defining a cylindrical surface around an axis of the reel member and a pair of flanges circumferentially surrounding the cylindrical surface and extending radially therefrom at respective ends thereof, one end of the string being attached to the reel member with the string wrapped around the reel member on the cylindrical surface and between the flanges leaving a free end of the string, said reel member further defining a sleeve member coaxial with said reel member axis and extending axially beyond one flange, said sleeve member having an outer peripheral surface of a diameter less than that of the flanges and an inner recess of a circular cylindrical shape extending axially therealong from an opening on a base surface of the sleeve member lying in a radial plane and remote from said one flange, said recess receiving said post at said first position on said instrument, said sleeve member including a transverse hole extending from the outer peripheral surface into said inner recess; a pin member mounted in the hole and having a length such that it can extend from the recess to a radial position beyond the diameter of the flanges and a diameter such that it can be pressed in a radial direction through said hole and through said transverse hole in said post; a cover member comprising an integrally molded unitary body having a circular end wall and a cylindrical flange extending axially from the periphery of the end wall, the cylindrical flange fully surrounding the cylindrical surface and extending from the end wall which lies closely adjacent an end face of the other of the flanges to an outermost edge of the cylindrical flange which extends just beyond said one of the flanges, said cylindrical flange and said one flange cooperating to locate said cover member against axial movement away from said reel member, the cylindrical flange including an opening therein through which the free end projects, said opening confining the string for removal from the reel member solely by longitudinal movement of the string caused by pulling of the free end, and means on the free end of the string for attachment of the free end to said second position on the instrument.

* * * * *